US006691777B2

(12) United States Patent
Murray et al.

(10) Patent No.: US 6,691,777 B2
(45) Date of Patent: Feb. 17, 2004

(54) SELF-LUBRICATING SWAGE

(75) Inventors: Douglas J. Murray, Humble, TX (US); William M. Bailey, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/925,396

(22) Filed: Aug. 9, 2001

(65) Prior Publication Data

US 2002/0062956 A1 May 30, 2002

Related U.S. Application Data

(60) Provisional application No. 60/225,460, filed on Aug. 15, 2000.

(51) Int. Cl.[7] ..... E21B 23/00
(52) U.S. Cl. ..... 166/216; 166/55; 166/384
(58) Field of Search ..... 166/207, 380, 166/384, 50, 242.1, 297, 55, 55.1, 209, 216

(56) References Cited

U.S. PATENT DOCUMENTS

| | | | | | |
|---|---|---|---|---|---|
| 1,641,519 | A | | 9/1927 | Andre | |
| 3,191,677 | A | * | 6/1965 | Kinley | 166/277 |
| 3,203,451 | A | * | 8/1965 | Vincent | 138/143 |
| 3,713,481 | A | * | 1/1973 | Webb | 166/55 |
| 3,818,734 | A | | 6/1974 | Bateman | |
| 4,502,308 | A | * | 3/1985 | Kelly | 29/421.1 |
| 4,505,987 | A | * | 3/1985 | Yamada et al. | 428/553 |
| 5,014,779 | A | * | 5/1991 | Meling et al. | 166/55.7 |
| 5,785,120 | A | * | 7/1998 | Smalley et al. | 166/207 |
| 6,029,748 | A | * | 2/2000 | Forsyth et al. | 166/277 |
| 6,325,148 | B1 | * | 12/2001 | Trahan et al. | 166/137 |
| 6,446,724 | B2 | * | 9/2002 | Baugh et al. | 166/177.4 |
| 6,450,261 | B1 | * | 9/2002 | Baugh | 166/216 |
| 2002/0100595 | A1 | * | 8/2002 | Cook et al. | 166/380 |

FOREIGN PATENT DOCUMENTS

| | | | | |
|---|---|---|---|---|
| FR | 2796399 A1 | * | 1/2001 | C23C/30/00 |
| GB | 2346165 A | | 8/2000 | |
| WO | WO 98/00626 A | | 8/1998 | |

* cited by examiner

*Primary Examiner*—David Bagnell
*Assistant Examiner*—Daniel P Stephenson
(74) *Attorney, Agent, or Firm*—Cantor Colburn LLP

(57) ABSTRACT

A self-lubricating swage expands tubulars and includes a primary swaging tool supported on a mandrel that has a lubricious capacity or a primary swaging tool supported on a mandrel and a nose swage member supported on an end of the mandrel. In the latter the nose swage member is fabricated of, is coated with or otherwise includes and applies a lubricious material that smears onto a surface coming into contact with the nose swage member. The smearing of the lubricious material facilitates the sliding of the swaging member as it contacts the inner walls of the tubular.

31 Claims, 8 Drawing Sheets

SELF-LUBRICATING SWAGE

CROSS REFERENCE TO RELATED APPLICATIONS

This application claims the benefit of an earlier filing date from U.S. Provisional Application Ser. No. 60/225,460 filed Aug. 15, 2000 which is fully incorporated herein by reference.

BACKGROUND

1. Field

The disclosure relates to oilfield downhole operations. More particularly, the disclosure relates to a self-lubricating swage device for expanding a tubular in a wellbore.

2. Prior Art

As is well known to those of skill in the art, expandable tubulars such as reformable deformed junctions have been known to the oilfield art. One will recognize the benefit of the exemplary deformed junction in that the junction is easily transported through the casing of a cased wellbore or through an open hole wellbore to its final destination at a junction between a primary and lateral borehole. Once the junction is properly positioned it is reformed into a Y-shaped junction to assist in completing the wellbore. In the fully reformed condition of the junction, the outer dimensions are generally greater than the ID of the casing or open hole. Thus of course it would be rather difficult to install the junction in its undeformed condition. Many methods have been used to expand tubulars or reform a deformed junction in the borehole. One of the prior art methods has been to employ a swaging device. Swaging devices generally comprise a conical or frustoconical hardened member having an outside diameter (OD) as large as possible while being passable through the wellbore casing or the open hole. This swage is urged to travel through a tubular or previously positioned deformed junction whereby the tubular or junction is reformed into an operational position. Where the tubular or junction is located in a vertical or near vertical wellbore, setdown weight alone often is sufficient to generate the approximately 100,000 pounds of force required to expand the tubular or reform the junction. Where the tubular or deformed junction is being placed in a highly deviated wellbore or a horizontal wellbore however, setdown weight might not be sufficient to force the swage device through the junction. In this event, one of skill in the art will recognize the hydraulic procedure alternative to setdown weight which includes an expansion joint located above the swage device, a drill tube anchor located above the expansion joint and a ball seat located below the expansion joint such that by dropping a ball, pressure can be applied to the tubing string whereby the expansion joint is forced to expand downhole which urges the swage device through the tubular or junction. Expansion joints are well known in the art, as are anchors and ball seats.

One of the problems encountered in swaging any tubular in a wellbore is the high frictional resistance that results from the contact between the swage and the contacted surface. Oftentimes the cross-sectional shape of the pipe is elliptical and not round. Swaging such a cross-sectional shape generates extremely high contact forces, which can cause galling and tearing of either or both of the swage and the pipe, which can in turn increase the force required to push the swage through the tubular.

Traditional methods of reducing friction include the use of conventional lubricants. In the application at hand, the use of conventional lubricants is limited because the lubricant must be applied to the surfaces immediately before the swage contacts the junction or the pipe. The biggest drawback to this type of application is the cost of placing the lubricant into a position where it can be utilized. Furthermore, since conventional lubricants typically have an adverse effect on cement used in the vicinity within the wellbore, such lubricants must be removed from the area before the cementing operation is commenced. There is a high cost associated with removing the lubricant prior to the application of the cement. Although a multitude of downhole lubricants and friction reducers are commercially available, hole depths and pipe configurations almost always render their use uneconomical.

Similar drawbacks are experienced during the removal of the prior art swaging devices. The obstacles encountered with respect to lubrication to force the swaging devices into a wellbore are the same as the obstacles encountered in the removal of the swaging devices from the wellbore. The metal (or other material) of the tubulars being expanded generally has a certain amount of resilience such that after the swage device has been forced through the tubular to expand it, the tubular itself will rebound to a smaller ID than the OD of the swage device by several thousandths of an inch. Because of the rebound, nearly as much lifting force is required on the swage device to remove it from the wellbore as is needed to initially urge the swage through the tubular. In the absence of any type of lubrication, this lifting force can be as much as 100,000 pounds. Although a drilling rig can easily pull ten times this weight, in a highly deviated or horizontal wellbore, the friction created on the curvature of the well can be high enough to absorb all of the force imparted at the surface and leave none available for the swage. Thus the tool is stuck. The amount of force necessary to pull the swage through the newly expanded and unlubricated tubular can also be sufficient to damage other well tools or tubulars. Such damage can of course cost significant sums of money to repair and require significant time both to diagnose and to repair.

SUMMARY

The self-lubricating swage avoids the above drawbacks by creating a self-lubricating single or two-part swage device. The single part device comprises a lubricious material associated with the swage. The two-part device comprises a primary swaging tool and second expansion device positioned ahead of the primary swaging tool for expanding a tubular in a wellbore. For simplicity, the second expansion device is termed a "nose swage". It will be understood that this term is not known to the applicants hereof to have any specific meaning in the art and is selected for use only to describe what is taught herein and the equivalents thereof. The self-lubricating nose swage can be utilized with any type of primary swaging tool. The primary swaging tool is supported on a mandrel, and the nose swage member is supported on an end of the mandrel. The nose swage member may be fabricated of a first lubricious solid material, which is preferably a smearable material such as bronze. Alternatively, the nose swage may be constructed primarily of a different first material and coated with a layer of lubricious material. Additionally or alternatively, the nose swage may contain a plurality of grooves disposed therein, which may be filled with a second lubricious material such as polytetrafluoroethylene. The self-lubricating swage device of the present invention is employable in place of a conventional swage, the function of which being fully assimilated.

BRIEF DESCRIPTION OF THE DRAWINGS

Referring now to the drawings wherein like elements are numbered alike in the several FIGURES.

DETAILED DESCRIPTION OF THE INVENTION

Figure 1:
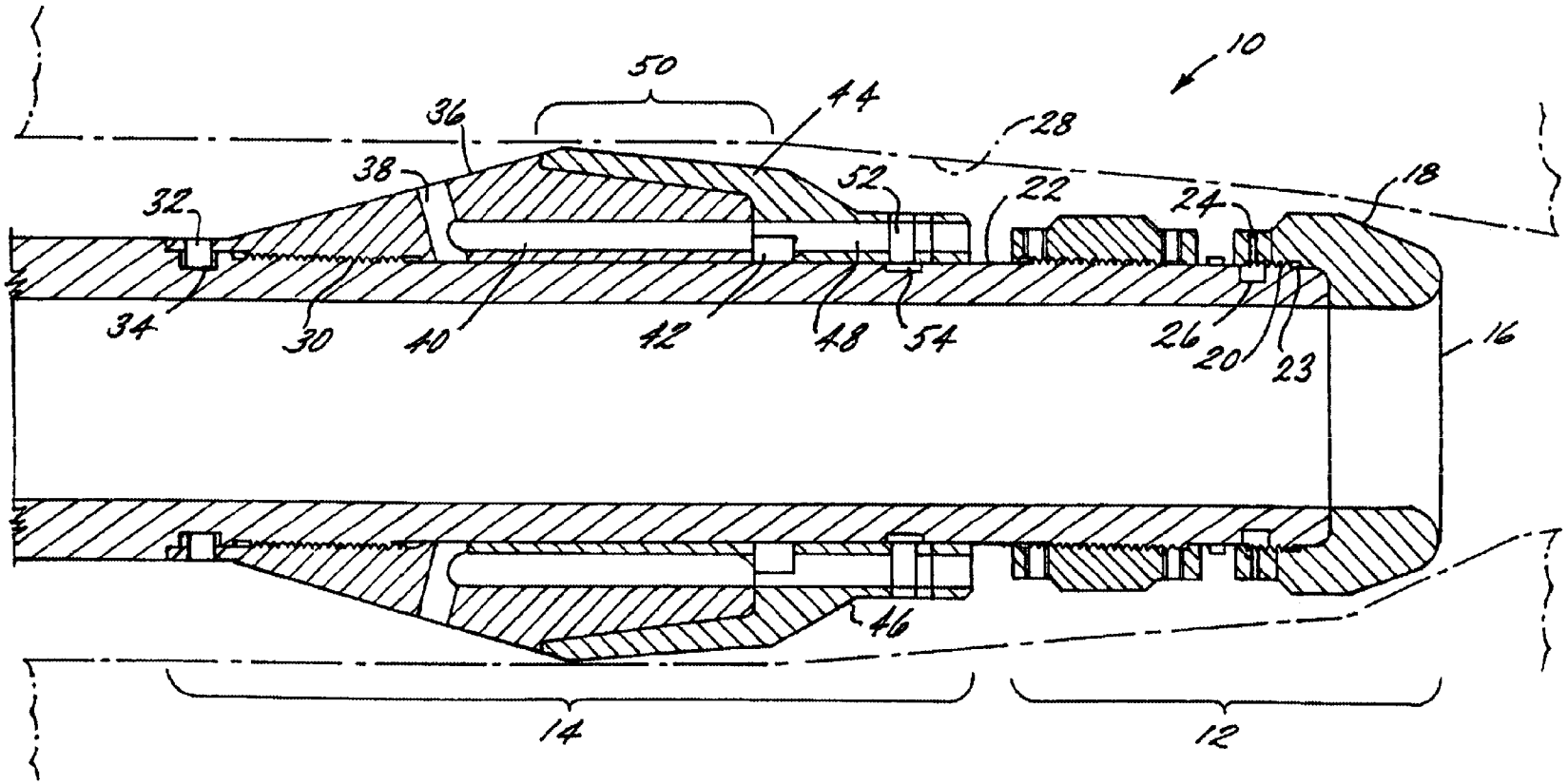
FIG. 1 is a side view of the swage in a swaging position.

Referring to FIG. 1, a self-lubricating swaging device is shown generally at 10. Swaging device 10 comprises a forward surface or nose swage shown generally at 12 and a primary swaging tool shown generally at 14.

Nose swage 12 is a tool of a cup-like structure having a head surface 16, a cavity opposing head surface 16, and an outer side surface 18 that defines a frustoconical shape of nose swage 12. A box thread 20 is provided for threadedly attaching nose swage 12 to a pin thread 23 on a mandrel 22. Nose swage 12 is locked into place on mandrel 22 by at least one setscrew 24, which is received in a groove 26 on mandrel 22.

One purpose of nose swage 12 is to act as a pre-expanding swage to begin the expansion process of a tubular. As swaging device 10 is forced through a hole (not shown) of the tubular (the inside surface of which is illustrated schematically in phantom lines) the outer side surface 18 of nose swage 12 begins to expand the tubular through contact with an inside surface 28 (shown in phantom lines) of the tubular. As nose swage 12 is pushed farther into the tubular, outer side surface 18 further pushes away inside surface 28 of the tubular to expand the tubular.

Another purpose of nose swage 12 is as a lubricator. To this end nose swage 12 is fabricated from a smearable low friction bearing material such as bronze (or coated in such material to a sufficient thickness to provide the needed lubrication, which is preferably about one quarter of an inch or greater thickness). As swaging device 10 is forced through the tubular, the contact force between outer side surface 18 of nose swage 12 and inside surface 28 of the tubular causes the material of nose swage 12 to smear onto inside surface 28. If swaging device 10 is being forced through a non-circular hole, the material of nose swage 12 smears off primarily onto inside surface 28 at the point of contact between outer side surface 18 and inside surface 28.

Figure 1A:
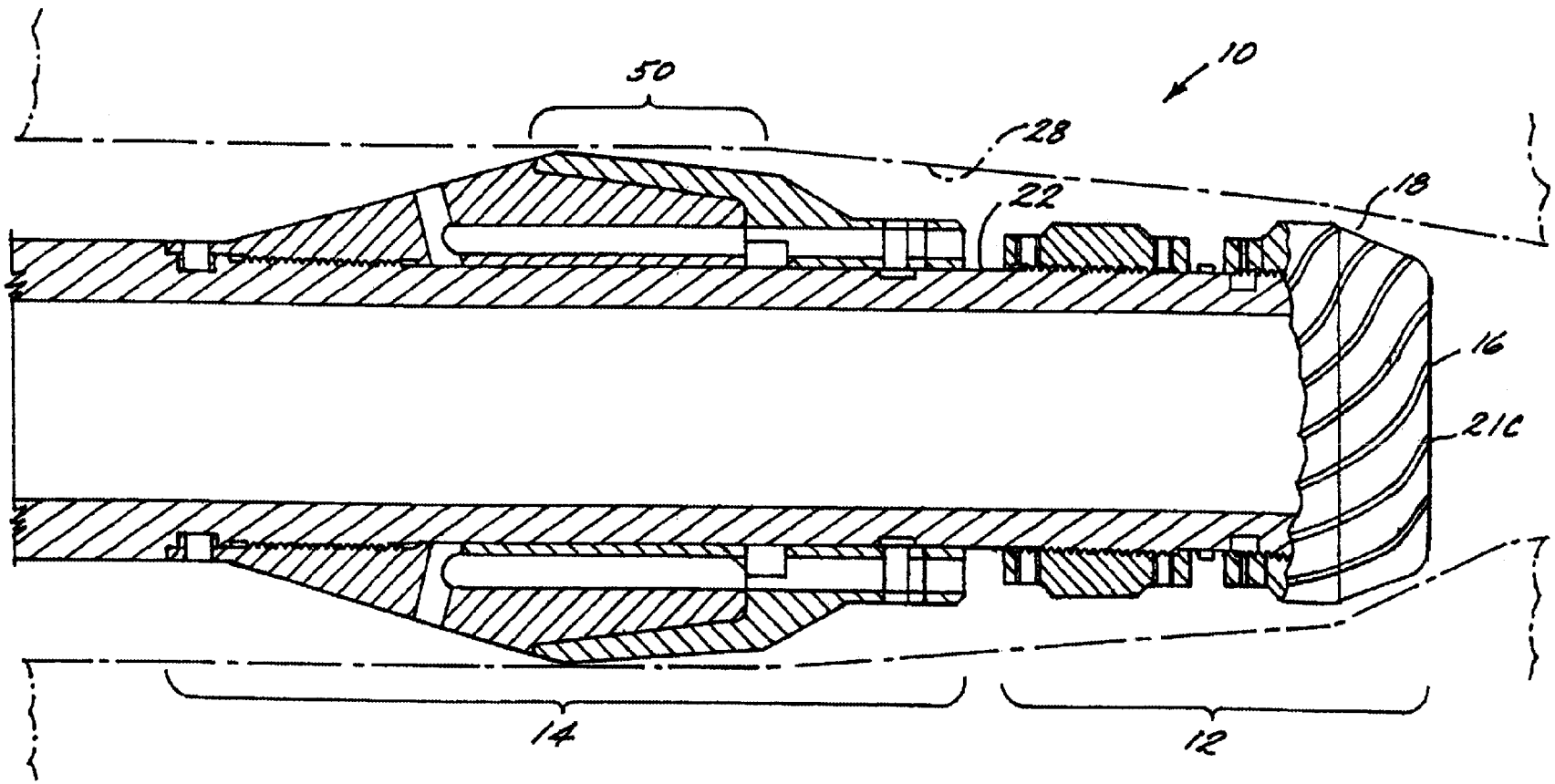
FIG. 1A is a side view of the nose swage, which has disposed within it a plurality of spiral grooves for accommodating a lubricious material.
Figure 1B:
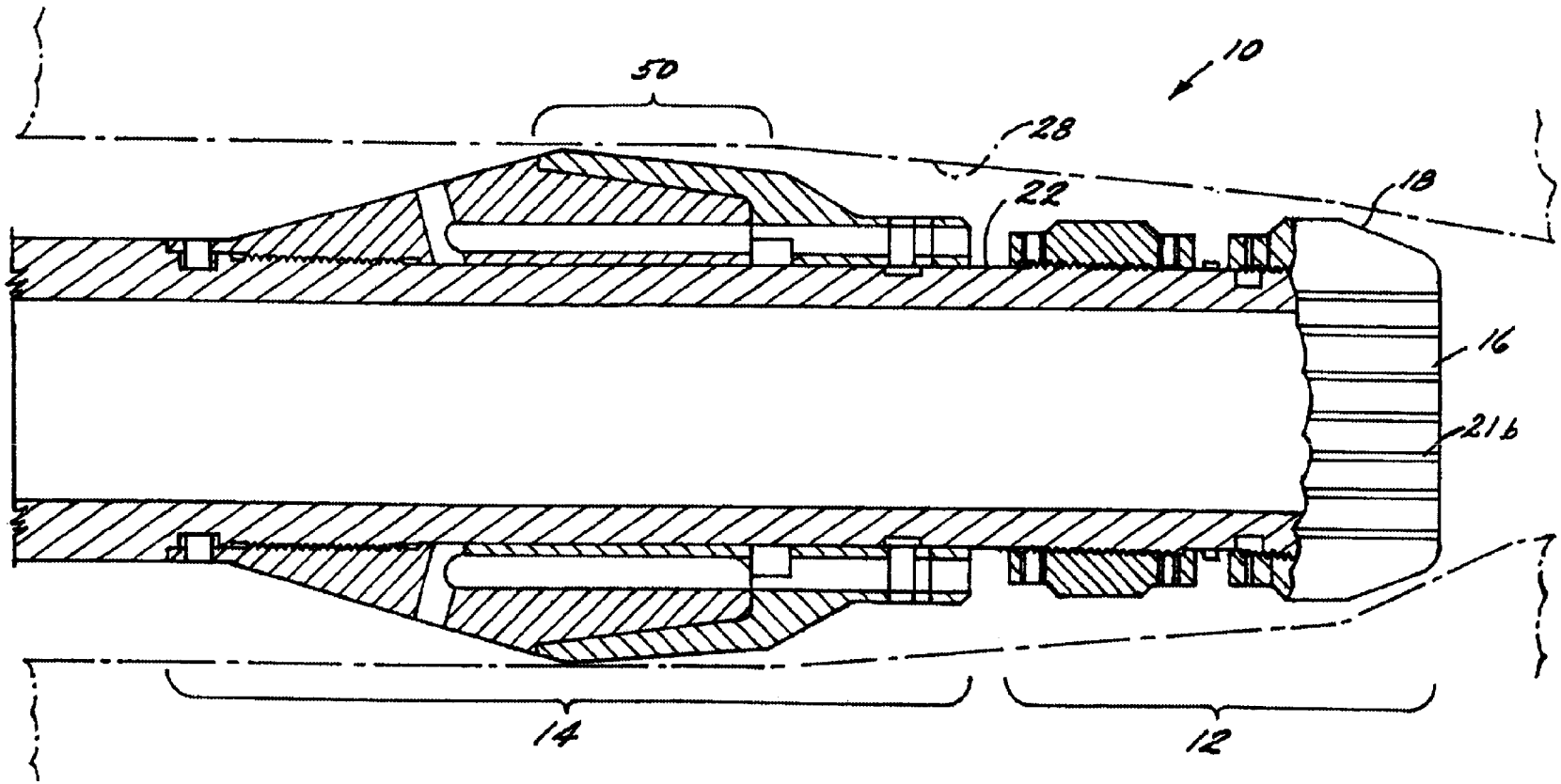
FIG. 1B is a side view of the nose swage which has disposed within it a plurality of longitudinal grooves for accommodating a lubricious material.
Figure 1C:
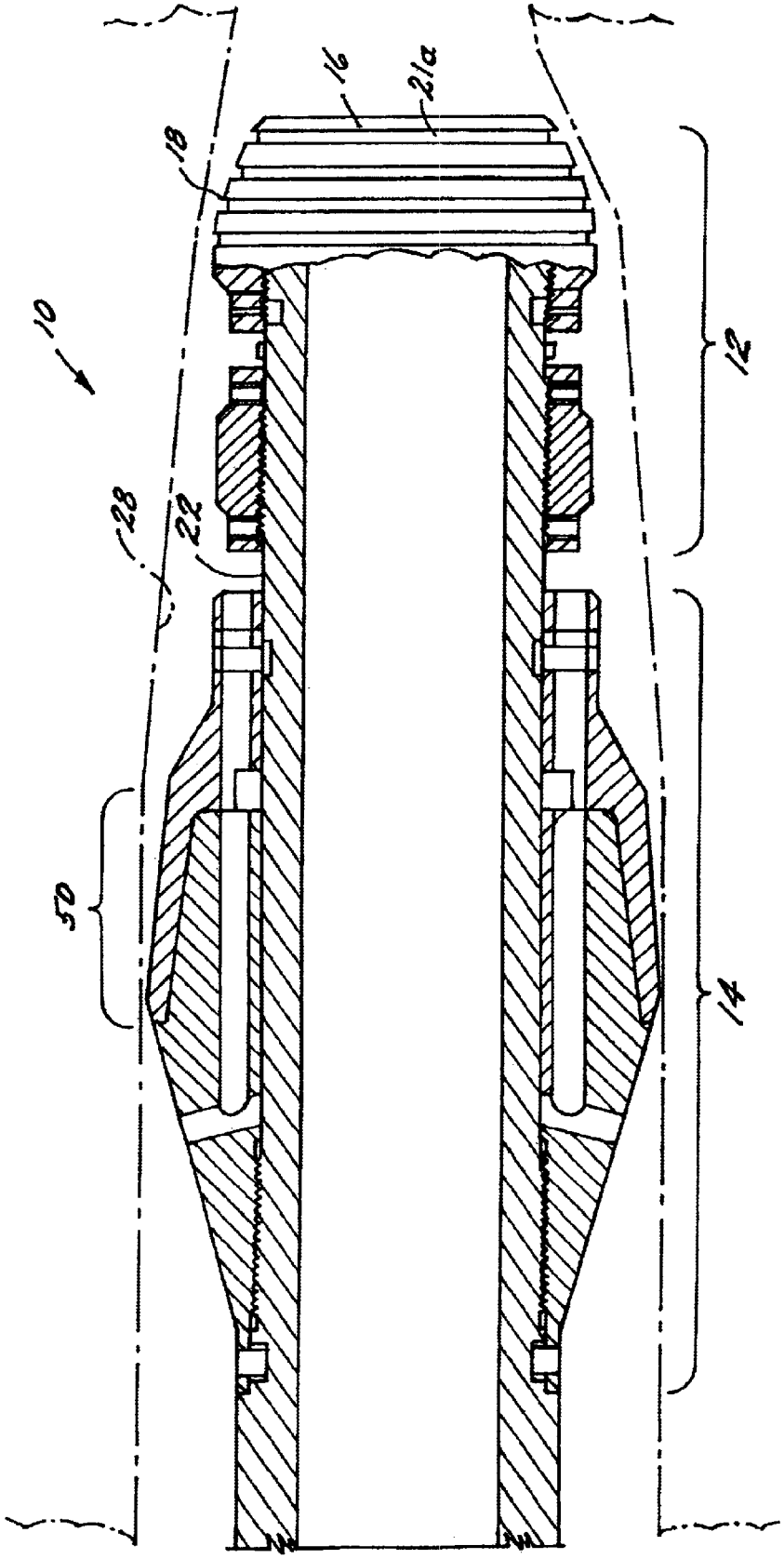
FIG. 1C is a side view of the nose swage which has disposed within it a plurality of concentric grooves for accommodating a lubricious material.

In an alternate embodiment, as shown in FIG. 1A, nose swage 12, still being composed of the smearable material, further contains a plurality of grooves 21 disposed therein. Grooves 21 may extend concentrically (21A) around nose swage 12, or they may extend from head surface 16 toward primary swaging tool 14 either longitudinally (21B) across outer side surface 18 or in a spiral configuration (illustrated as 21C). Grooves 21 are packed with a lubricant (not shown), which is typically a thin film bonded lubricant, such as polytetrafluoroethylene, molybdenum disulfide, graphite, or a similar material. When nose swage 12 contacts inside surface 28 and the surface of nose swage 12 is smeared away, the lubricant is also smeared onto inside surface 28 to further facilitate the sliding of swaging device 10 through the junction. If, on the other hand, nose swage 12 is fabricated of a non-smearable material, then grooves 21 may be packed with a smearable material, such as bronze, or a thin film bonded lubricant, such as polytetrafluoroethylene, molybdenum disulfide, graphite, or a similar material. It will be appreciated that the point of the nose swage is to effectively apply the lubricious material to the ID of the tubular being expanded. The nose swage may be constructed of any material that supports that purpose. This includes metals, plastics, etc.

Figure 4:
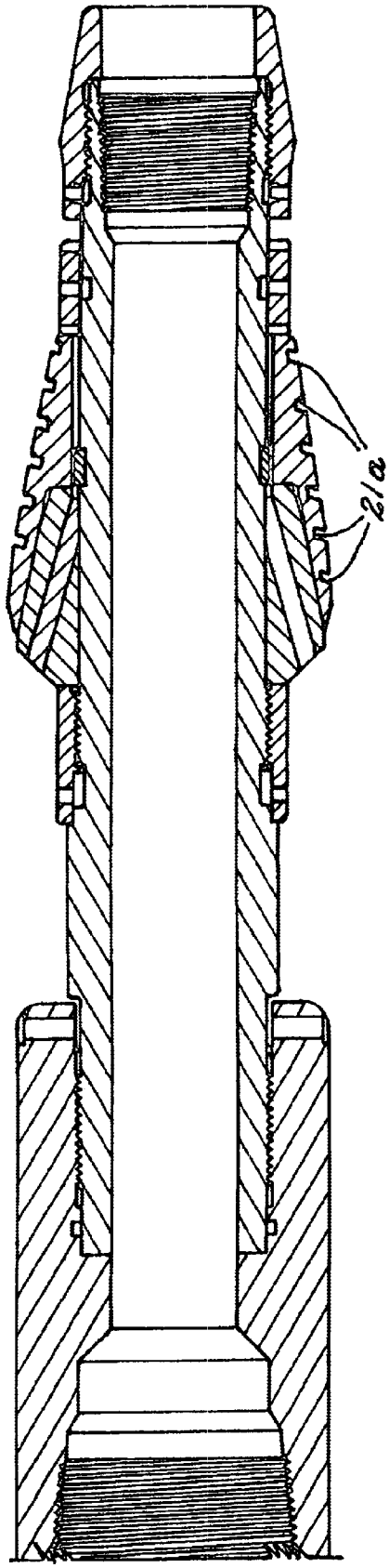
FIG. 4 is a side view of an alternative embodiment with a helical groove thereon for receiving a lubricious material.
Figure 4A:
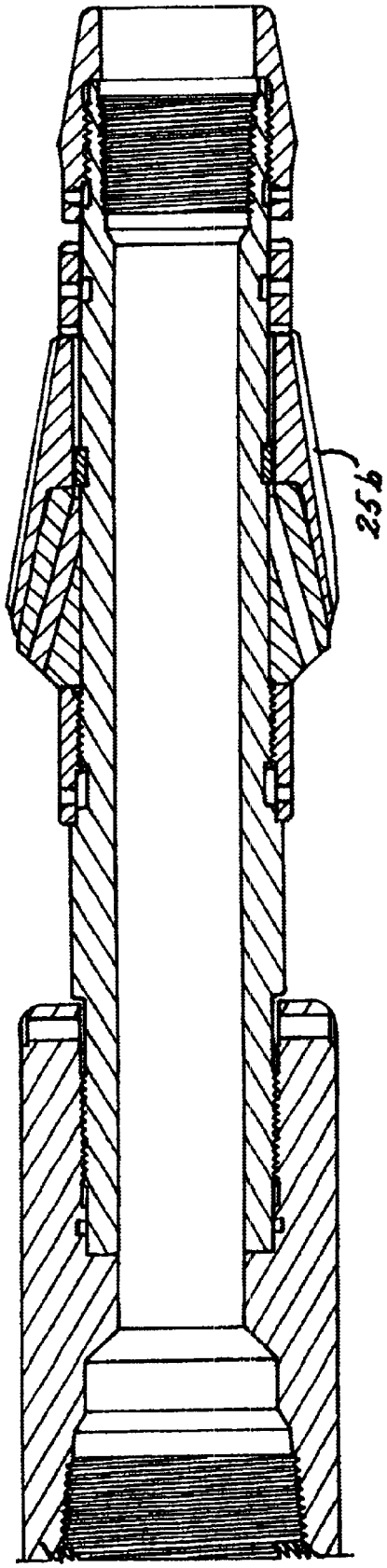
FIG. 4A is a side view of an alternate embodiment having longitudinal grooves for accommodating a lubricious material.

In another embodiment, nose swage 12 is not used but rather the primary swage 14 is provided with a groove pattern (illustrated as 21*a* in FIG. 4) or a lubricious coating on a surface thereof (not shown). The materials may be any of those disclosed hereinabove or similar acting materials. In FIG. 4, the primary swage with a helical pattern of grooves (25A) thereon is illustrated In FIG. 4A a longitudinal pattern of grooves 25B is illustrated.

Referring back to FIG. 1, primary swaging tool 14 is shown mounted on mandrel 22 by a threaded connection 30 and a plurality of setscrews 32. Each setscrew 32 is received in a groove 34, the combination of which with threaded connection 30 prevents movement of a support 36. Support 36 is preferably a frustoconical annular element of a single piece, although multiple pieces could be used to achieve the desired result. Support 36 is provided with at least one port 38, the outlet of which is positioned uphole of a point of contact of swaging device 10 with inside surface 28 of the junction being deformed. Preferably, several ports 38 are positioned on support 36. Port 38 also intersects an upper bore 40 extending axially through support 36, of which there are preferably several configured within support 36. Upper bore 40 is open to an annular space 42. As should be understood, there may be several bores 40 opening into annular space 42.

Support 36 is shown in FIG. 1 supporting a swage cup 44 and thereby preventing the deflection of swage cup 44 toward mandrel 22. Swage cup 44 extends outwardly from a swage cup base 46. A lower bore 48 extends axially through swage cup base 46, opens on the downhole end of swage cup base 46, and is configured to receive well fluid (not shown) downhole of a contact area 50 of swage cup 44. Lower bore 48 extends to an uphole end that communicates with annular space 42. Annular space 42 ensures communication between lower bore 48 and upper bore 40 thus effecting through passage of well fluids from below the contact point 50 of swage cup 44 with inside surface 28 (which forms a metal-to-metal seal) to port 38 above contact point 50. By this provision, a hydraulic lock is avoided under swage cup 44, which would otherwise prevent movement of swaging device 10 through the tubular. If provision for fluid flow-through was not provided, it might become more difficult to move swaging device 10 through the junction since overcoming a hydraulic lock would be extremely difficult without an outlet for fluid pressure.

Swage cup 44 and swage cup base 46 are located on mandrel 22 by shear screws 52 only. Swage cup 44 and swage cup base 46 are preferably fabricated so as to be a single annular component that is slideable along mandrel 22. Therefore, a means of holding swage cup 44 and swage cup base 46 in the swaging position on support 36 is needed. One embodiment of such means is shear screws 52 that are received in groove 54. It will be recognized by one of ordinary skill in the art that since shear screws 52 are the only means in this embodiment which hold swage cup 44 and swage cup base 46 in place, swage cup 44 and swage cup base 46 may rotate 360° around mandrel 22 relatively freely. The significance of annular space 42 then is to ensure that lower bore 48 is in fluid communication with upper bore 40 no matter what orientation the swage cup 44 and swage cup base 46 have relative to support 36.

Figure 2:
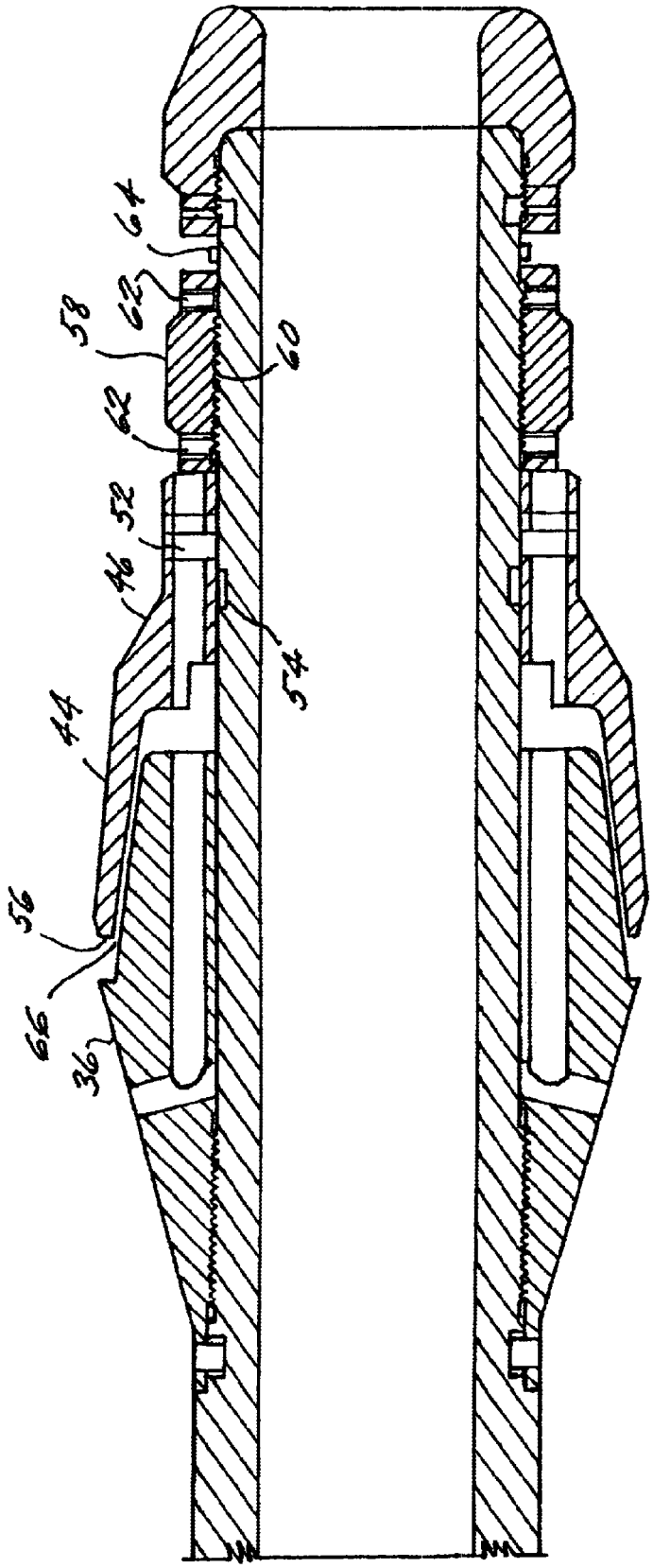
FIG. 2 is a side view of the device wherein the swage cup has been moved to a second position, which is the retrieving position.

In the condition shown in FIG. 1, one of ordinary skill in the art should appreciate that swaging device 10 being forced through a tubular will quite effectively expand the tubular similarly to prior art swages. Once the expansion is complete and it is desirable to remove the swaging tool from the wellbore, an upward pull is necessary. The configuration of the tool as it is being pulled up the wellbore is shown in FIG. 2. Referring now to FIG. 2, upon pulling swaging device 10 in the upward direction point 56 of swage cup 28 will contact the inside diameter (not shown) of the tubular due to the resilience of the tubular as discussed hereinbefore. The pressure on point 56 will tend to prevent swage cup 44 from moving uphole. This force is translated through swage cup base 46 to shear screws 52 (or other retaining arrangement) that will then shear under that force (or release in some other way). One of skill in the art will recognize that the particular amount of force required to shear the screws is engineerable in advance and should be matched to an appropriate amount of force to indicate that withdrawal of swaging device 10 is desired. Upon shearing of screws 52, swage cup base 46 and swage cup 44 move downhole until swage cup base 46 is in contact with a swage stop 58. It should be briefly noted at this point that swage stop 58 is connected to mandrel 22 via a regular thread 60 and a plurality of setscrews 62. Swage stop 58 further includes an o-ring 64 to seal swage stop 58 against mandrel 22.

Upon shifting swage cup 44 and swage cup base 46 downhole into contact with swage stop 58, a gap 66 is formed between swage cup 44 and support 36. Because of gap 66, continued pulling on swaging device 10 causes swage cup 44 to deflect toward mandrel 22 to a degree that is sufficient to allow it to slide through the junction. A desired mount of deflection to achieve the stated result is several thousandths of an inch. Gap 66 may be anywhere from several thousandths of an inch to a larger gap. The deflection of swage cup 44 will merely be what is necessary for it to move through the junction at a significantly reduced force as it is being withdrawn from the wellbore.

Figure 3:
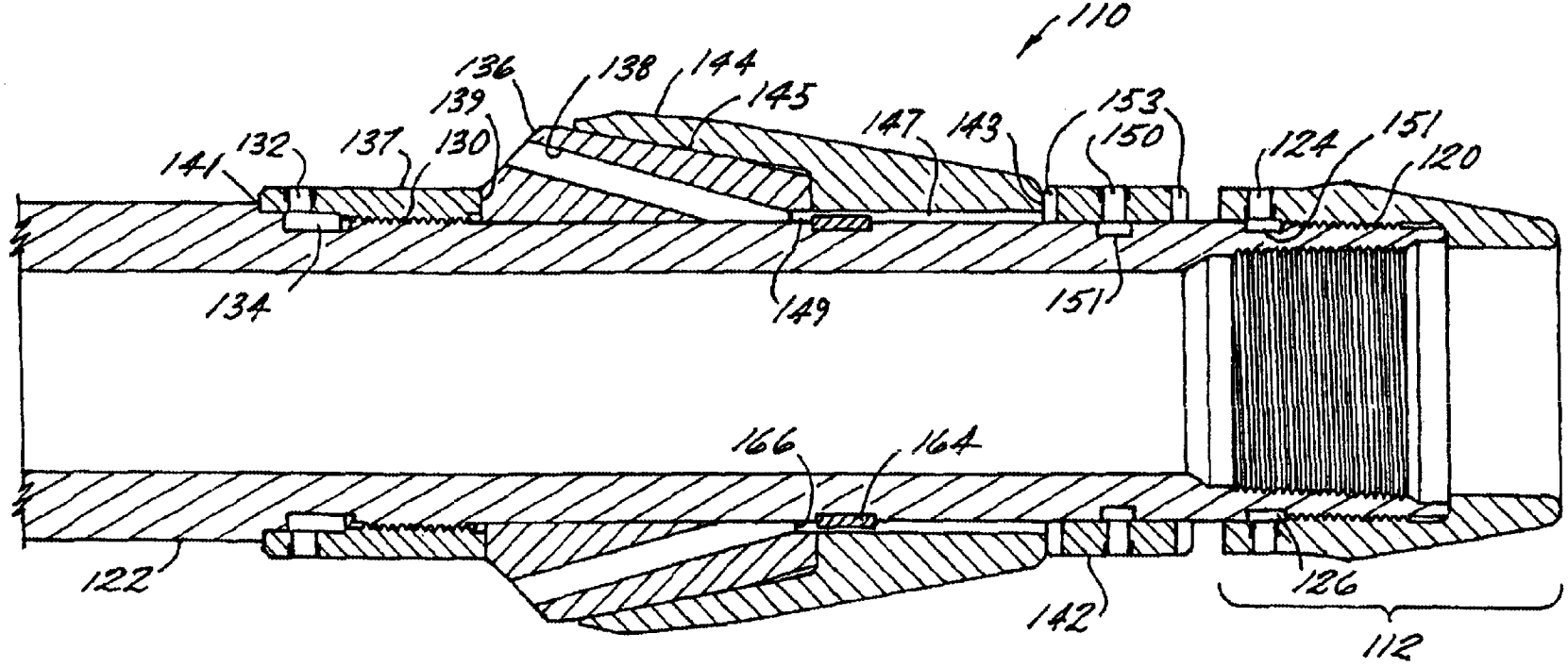
FIG. 3 is a cross section view of a second embodiment.

Referring now to FIG. 3, a second embodiment of the invention is shown generally at 110. The general mode of operation remains but the way in which it is carried out is slightly different. Since each of the components of this embodiment is slightly different than each of the counterparts in the first described embodiment, the components of the new embodiment are numbered in multiples of one hundred.

At the downhole end of swaging device 110, a self-lubricating nose swage 112 is threadedly attached to a mandrel 122 at a thread 120 and is locked in place by at least one setscrew 124, which is received in a groove 126. Nose swage 112, in addition to acting as a pre-forming swage to open tight tubulars, prevents a shear ring (release ring) 142 from falling off the end of mandrel 122 after a shear screw (or other release) 150 is sheared.

In the operational condition, with shear screw 150 intact, the space between the uphole end of nose swage 112 and downhole end of shear ring 142 is preferably sufficient to allow full shearing of shear screw 150 by displacement of shear ring 142 in the downhole direction before the noted surfaces interengage. This prevents a partial shearing condition which may impede performance to some degree although should not completely prevent swaging device 110 from performing.

Mandrel 122 supports the swaging device and, through its movement, activates the same. In the running position (shown), a swage ring support 136 is in position to support a swage ring 144. Both swage ring support 136 and swage ring 144 in this embodiment "float" on mandrel 122 (i.e., swage ring support 136 and swage ring 144 are not attached to mandrel 122). At the uphole end, swage ring support 136 is prevented from moving further uphole by a retaining ring 137. Retaining ring 137 is threadedly connected to mandrel 122 by a thread 130 and is prevented from moving on thread 130 by at least one setscrew 132, which is received in a groove 134. In a preferred embodiment, mandrel 122 is "turned down" from a shoulder 141 to be positioned even with the uphole end of retaining ring 137 and extending to the downhole end of swaging device 110. This provides more annular area between the mandrel surface and the borehole or junction so that thicker swage components may be used. The "turn down" from shoulder 141 also provides extra stability to retaining ring 137.

Swage ring support 136 abuts retaining ring 137 at an interface 139 and includes a fluid bypass 138. Support for swage ring 144 is along an interface 145. As a unit, swage ring support 136 and swage ring 144 function as they did in the previous embodiment and indeed as do those of the prior art to expand a tubular. It is with the recovery of swaging device 110 that its unique construction is evident and beneficial. It should be noted that swage ring 144 includes at least one fluid bypass conduit 147 that communicates with an annulus 149.

Located downhole of swage ring 144 is shear ring 142. Swage ring 144 is abutted against shear ring 142 at an interface 143. Shear ring 142 is prevented from longitudinal movement on mandrel 122 by a plurality of shear screws 150, which engage a groove 151 on mandrel 122. Shear ring 142, in conjunction with retaining ring 137, maintains swage ring support 136 and swage ring 144 in the operative running and reforming position. It should be noted that slots 153 are provided on both the uphole and downhole sides of shear ring 142 in a preferred embodiment to allow for fluid bypass. While only the uphole end of shear ring 142 requires slots 153 to allow fluid bypass, placing slots 153 on both ends assures that fluid bypass will occur even in the event that swaging device 110 is assembled backwards.

Once swaging device 110 has been forced through the tubular being expanded, it is normally withdrawn or pulled uphole. In the event that swaging device 110 encounters significant resistance, the features disclosed herein will be set in motion. Since both swage ring support 136 and swage ring 144 are not connected to mandrel 122, resistance provided by the deformed junction is translated directly to shear screw 150. At a predetermined amount of force, shear screw 150 will shear and allow mandrel 122 to move uphole. At this point, shear screw 150 has sheared, but swage ring support 136 has not been moved relative to swage ring 144. Thus, the frictional engagement therebetween is rendered independent and not cumulative with respect to the amount of force necessary to shear screw 150. Upon movement of mandrel 122 uphole, a snap ring 164 impacts a shoulder 166 on swage ring support 136 and will move snap ring 164 out of its support position under swage ring 144. This, as in the previous embodiment, allows swage ring 144 to flex, thereby allowing retrieval of swaging device 110. In practice, the disengagement of swage ring support 136 with swage ring 144 is assisted by a jarring action that normally results from the sudden shear of screw 150. It should be noted, however, that a straight pull on swaging device 110 would also dislodge swage ring support 136 from swage ring 144. The jamming action is a likely mode of operation; however, it is not a required mode of operation. Overcoming the friction generated by the flexible swage ring 144 being urged into contact with swage ring support 136 by the junction is all that is necessary. After shearing, swage ring 144 and shear ring 142 will rest on nose swage 112 while support shoulder 166 will rest on snap ring 164. In this condition, support for swage ring 144 is not available and swage ring 144 is free to flex, thereby allowing swaging device 110 to be recovered from the junction. Commonly, the flexing that will occur is into a slight oval shape.

It should be appreciated that in both embodiments of the invention the shear release or other release mechanism may not be used in all conditions. The swaging device 10 may pull through the junction without needing to be flexible. Because the tools of each embodiment incorporate the invention, swaging device 10 of either embodiment is retrieved whether or not swaging device 10 gets stuck in the junction. If swaging device 10 does get stuck, shear screw(s) 52 will shear on continued pickup of swaging device 10 and swaging device 10 will operate as hereinbefore described.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A self-lubricating swage for expanding a tubular in a wellbore comprising:

a primary swaging tool supported on a mandrel; and a nose swage member supported on an end of said mandrel, said nose swage member comprising a first lubricious material.

2. A self-lubricating swage as claimed in claim 1 wherein said nose swage member comprises a smearable material.

3. A self-lubricating swage as claimed in claim 2 wherein said smearable material is bronze.

4. A self-lubricating swage as claimed in claim 1 wherein said nose swage contains a plurality of grooves disposed therein, said grooves being filled with a second lubricious material.

5. A self-lubricating swage as claimed in claim 4 wherein said second lubricious material is polytetrafluoroethylene.

6. A self-lubricating swage as claimed in claim 4 wherein said grooves are concentrically arranged on said nose swage member.

7. A self-lubricating swage as claimed in claim 4 wherein said grooves are longitudinally arranged on said nose swage member.

8. A self-lubricating swage as claimed in claim 4 wherein said grooves are spirally arranged on said nose swage member.

9. A self-lubricating swage for expanding a tubular in a wellbore comprising:

a primary swaging tool supported on a mandrel; and a nose swage member supported on an end of said mandrel, said nose swage member containing grooves containing a lubricious material.

10. A self-lubricating swage as claimed in claim 9 wherein said lubricious material is bronze.

11. A self-lubricating swage as claimed in claim 9 wherein said lubricious material is polytetrafluoroethylene.

12. A self-lubricating swage as claimed in claim 9 comprising a solid smearable lubricious material disposed thereat.

13. A self-lubricating swage as claimed in claim 12 wherein said lubricious material is metal.

14. A self-lubricating swage as claimed in claim 12 wherein said lubricious material is bronze.

15. A self-lubricating swage as claimed in claim 12 wherein said lubricious material is plastic.

16. A self-lubricating swage for expanding a tubular in a wellbore comprising a frustoconically-shaped body portion wherein at least a portion of said body portion consists of a first solid smearable material.

17. A self-lubricating swage as claimed in claim 16 wherein said at least a portion is defined by an entirety of said body portion.

18. A self-lubricating swage as claimed in claim 16 wherein said first solid smearable material is a lubricious material.

19. A self-lubricating swage for expanding a tubular in a wellbore comprising a frustoconically shaped body portion including grooves and having a first solid smearable material disposed in said grooves.

20. A self-lubricating swage as claimed in claim 19 wherein said grooves are longitudinally arranged on said body portion.

21. A self-lubricating swage as claimed in claim 19 wherein said grooves are angularly arranged on said body portion.

22. A self-lubricating swage as claimed in claim 19 wherein said grooves are helically arranged on said body portion.

23. A self-lubricating swage as claimed in claim 19 wherein said body portion is fabricated of a non-smearable material and wherein said grooves contain said first solid smearable material.

24. A self-lubricating swage for expanding a tubular in a wellbore comprising a frustoconically shaped body portion wherein at least a portion of said body portion includes a first solid smearable material and wherein said body portion contains grooves having a second smearable material disposed therein.

25. A self-lubricating swage comprising a primary swaging member having at least one groove in an outer surface thereof prior to a swaging operation, said at least one groove having a lubricious material associated therewith.

26. A self-lubricating swage as claimed in claim 25 wherein said at least one groove is longitudinally arranged on said primary swaging member.

27. A self-lubricating swage as claimed in claim 25 wherein said at least one groove is angularly arranged on said primary swaging member.

28. A self-lubricating swage as claimed in claim 25 wherein said at least one groove is helically arranged on said primary swaging member.

29. A self-lubricating swage as claimed in claim 25 wherein said lubricious material is metal.

30. A self-lubricating swage as claimed in claim 25 wherein said lubricious material is bronze.

31. A self-lubricating swage as claimed in claim 24 wherein said lubricious material is plastic.

* * * * *